US007441345B2

(12) United States Patent
Taylor

(10) Patent No.: US 7,441,345 B2
(45) Date of Patent: Oct. 28, 2008

(54) LAUNDERING AID REMOVING ADHERENT MATTER FROM FABRIC ARTICLES

(76) Inventor: Ken Taylor, 741 Highway 38, Dayton, IN (US) 47941

( * ) Notice: Subject to any disclaimer, the term of this patent is extended or adjusted under 35 U.S.C. 154(b) by 52 days.

(21) Appl. No.: 11/422,424

(22) Filed: Jun. 6, 2006

(65) Prior Publication Data

US 2006/0288600 A1 Dec. 28, 2006

Related U.S. Application Data

(60) Provisional application No. 60/687,944, filed on Jun. 7, 2005.

(51) Int. Cl.
*F26B 5/04* (2006.01)

(52) U.S. Cl. ..... 34/406; 34/90

(58) Field of Classification Search ..... 34/60, 34/86, 90, 406; 68/235 R; 428/36.5; 510/519
See application file for complete search history.

(56) References Cited

U.S. PATENT DOCUMENTS 3,706,140 A * 12/1972 Brillaud et al. ..... 34/60
4,004,685 A * 1/1977 Mizuno et al. ..... 206/0.5
4,014,105 A * 3/1977 Furgal et al. ..... 34/389
4,532,722 A * 8/1985 Sax ..... 34/60
4,567,675 A * 2/1986 Rennie ..... 34/60
4,691,400 A * 9/1987 Arneson ..... 15/3
4,920,662 A * 5/1990 Seeburger ..... 34/60
D396,904 S * 8/1998 Leu ..... D32/29.1
6,174,577 B1 * 1/2001 Vitorino ..... 428/36.5
D516,261 S * 2/2006 Roberts ..... D32/25

* cited by examiner

*Primary Examiner*—S. Gravini
(74) *Attorney, Agent, or Firm*—Buchanan Intellectual Property Office LLC

(57) ABSTRACT

A laundering aid having a core member, such as an elastomeric ball member, that includes a covering comprising an abrasive or brush-like material adapted for engaging and lifting matter, such animal hair, adherent to the surface of fabric articles when the laundering aid is placed into contact with clothing and other fabric articles within an operating tumble-type clothes dryer. The covering may further include a second material comprising a material that substantially lacks characteristics for lifting matter from other fabric, the first material being disposed adjacent to or over the first material to form a series of discrete sections having different properties that facilitate the dislodgement and or removal of the hair or other fine matter. The exemplary elastomeric ball member may be inflated for shape retention, while allowing for expansion when heated during the drying cycle. An exemplary method for using the laundering aid comprises the steps providing a laundering aid comprising a brush-like or abrasive outer covering adapted to engage and lift adherent matter and introducing the device into a tumble-type dryer with one more fabric articles, then operating the dryer until the adherent matter on the fabric articles has been substantially dislodged and vented from the drying chamber.

15 Claims, 3 Drawing Sheets

LAUNDERING AID REMOVING ADHERENT MATTER FROM FABRIC ARTICLES

CROSS-REFERENCE TO RELATED APPLICATIONS

This application claims priority of provisional application Ser. No. 60/687,944, filed Jun. 7, 2005.

TECHNICAL FIELD

This invention relates to devices utilized in the laundering of clothing and other fabric articles, more particularly to devices for removing mammalian hair and other adherent matter from fabric during the drying cycle.

BACKGROUND OF THE INVENTION

Hair or fur shed from pet cats, dogs, and other mammals can be particularly difficult to remove from clothing and other fabric articles during the laundering process because of its tendency to remain adherent to the fibers of the fabric, even after the washing and drying cycle has been completed. This problem can extend to lint and other fine material that can cling to fabric and resist dislodgement during normal washing and drying, whether using household appliances or commercial laundering equipment. The primary recourse has remained the use of brushes, mitts, adhesive rollers, and similar devices to manually remove pet hair and other adherent matter before or after laundering.

The majority of fur-bearing mammalian species have coats comprising multiple types of hairs having different properties that fulfill a particular function. For example, the down or secondary hairs are what form the undercoat of cats, keeping the animal warm, and typically comprise about 75% of the coat in most breeds. These hairs are short, fine, and generally kinked or wavy, properties that make them adherent to fabric surfaces. The next most common type, the awn hairs, protect the down hairs and are intermediate-sized with a rough cuticle surface that facilitate attachment to clothing fibers. The remaining hairs are the guard hairs, which comprise the visible topcoat of the animal. The cuticles of these hairs include microscopic barbs that make them particularly adherent to clothing. The type of coat found on a dog depends on the breed, but it typically comprises a topcoat of guard hairs that protect an undercoat of fine secondary or down hairs. Other than most primate and ungulate species (which typically lack the fine down hair undercoat), the majority of other mammalian species have at least both guard hairs and the secondary down hairs, these being similarly problematic when coming in contact with clothing or other fabric articles being laundered.

The problem of adherent animal hair and other fine matter is compounded during the drying phase of the laundering process because the environment is conducive for the buildup of static electricity, especially as the moisture from the laundered clothing is removed. In a tumble-type dryer, clothing articles make continual contact with the drum of the dryer and the surfaces of other articles. The resulting friction contributes to a buildup of electrostatic charge on the fabric article surfaces. This phenomenon is known as the triboelectric effect, which is a type of contact electrification in which certain materials become electrically charged after coming into contact with another different material and are then separated. The polarity and strength of the charges produced differ according to the materials, surface roughness, temperature, strain, and other properties. Thus, it is difficult to predict how a material will behave and only broad generalizations can be made. Many fabrics, especially wools and synthetics, have an inherent propensity to acquire either a positive or negative charge by losing or absorbing electrons, respectively. The electron (or proton) affinity of a particular material (its tendency to become positively or negatively charged) determines its position on the Triboelectric Series continuum. It is known that certain natural fibers, such as wool, typically acquire a positive charge, while polyester and most other synthetics fabrics tend to acquire a negative charge during frictional contact with another surface (nylon being an exception). Polytetrafluoroethyene (PTFE) and silicone rubber are materials having one of the strongest tendencies to acquire electrons and become negatively charged. Cotton fabric does not readily acquire either a positive or negative charge, but may either shed or acquire electrons during the drying phase. Fur and hair tends has a tendency to acquire a positive charge and may be drawn to negatively charged fabric surfaces, such as polyester, making them even more likely to adhere to the clothing. In particular, rabbit fur particularly is located well toward the positive charge end of the Triboelectric Series and is often used to generate static electricity (often by rubbing it on silk). Like most materials, however, hair or fur can become either positive or negative charged, depending on the environment and circumstances to which they are subjected.

Another factor complicating the removal of adherent matter is that during the drying cycle, clothing and other fabric articles typically become positively or negatively charged and become attractive to other oppositely charged articles. This causes the well-known phenomenon of static cling, which can trap hair-covered surfaces and other matter between articles, further adding to the problem by limiting the exposed surfaces from which hair, lint, etc, may dislodge. Chemical agents introduced during the drying cycle to reduce static cling have not provided a satisfactory solution to the problem of dislodging or removing hair clinging to fabric. Tennis balls and certain devices designed for use in the dryer, such as the commercially available Dryer Max™ Dryer Ball (a polymeric ball with a series of projections adapted to engage fabric), also have been reported to help separate clothing articles and reduce static cling within the dryer. Yet, these devices have generally proven largely inadequate in helping to dislodge pet hair and certain other foreign material on fabric surfaces, indicating that static alone is not the main culprit in the problem of lifting away animal hair. Adhesive-covered articles have been proposed as a laundering aids to lift and transfer hair from the fabric surfaces during the drying phase, but there are obvious limitations with this approach. The high moisture present in the initial phases of the drying cycle can rapidly degrade the effectiveness of the adhesive. This, along with the gradual accumulation of transferred matter, can render the adhesive insufficiently tacky to effectively pull hair from the fibers of the fabric and transfer it to the adhesive surface. Electrostatic attraction has been utilized in pet brushes as an additional means of lifting away hair, but static electricity alone is generally ineffective to dislodge adherent hairs from most fabric articles within the dryer environment.

What is needed is a laundering aid that can be effective within the environment of a tumble-type clothes dryer in reducing static cling while lifting away pet hair and other finer matter adhering to clothing and other fabric articles such that the amount of foreign matter remaining on the fabric surfaces would be greatly reduced when compared to standard drying practices.

SUMMARY OF THE INVENTION

The foregoing problems are solved and a technical advance is achieved in an illustrative laundering aid configured to toss along with clothes during the drying cycle of a tumble-type clothes, the laundering aid having a covering comprising an abrasive surface distributed over at least a portion thereof that is configured to physically lift and dislodge adherent matter from the surfaces of fabric articles such as clothing, sheets, blankets, pillows, etc. The surface structure is particularly adapted to remove adherent matter comprising hair or fur from common pet species or other mammals, along with lint, fibers, threads, and other fine debris that has become adherent to a fabric surface especially matter that is typically difficult to remove using standard laundering techniques. Furthermore, the action of the laundering aid helps to separate clothing and reduce static cling, which may further enhance the action of the laundering aid in removing adherent matter from the fabric articles.

In one aspect of the present invention, the laundering aid comprises a core member comprising one or more elements, such as a ball member or other hollow or solid object that is generally spherical or non-spherical in shape. The core member may comprise a polymeric material, such as a natural or synthetic elastomeric material, or it may be rigid or semi-rigid. The core member may be partially inflated with a fluid, such as air, such that it retains its shape during use, but allows for expansion as the air inside become heated during the drying process so that the inflated member does not rupture. The laundering aid further includes a covering disposed over the core member that includes at least a first material, such as a fabric or other layer comprising a brush-like surface distributed thereover that is adapted for engaging and lifting adherent matter, such as fine mammalian hair, from the surface of fabric articles when placed therewith inside an operating tumble-type clothes dryer. In one particular embodiment, the first material is comprises a brush-like surface having a configuration that facilitates the dislodgement of adherent matter transferred to the surface of the first material rather than being configured to trap or retain such matter as it is dislodged from the fabric articles. This advantageously permits the largest proportion of the dislodged hairs and other fine matter to be vented from the dryer (e.g., deposited in the lint trap within the outlet of the dryer) rather than being transferred directly from the fabric articles to the surface of the laundering aid and maintained there. One exemplary brush-like surface of the first material comprises a plurality of angled microfiber bristle elements that are effective for engaging and lifting hair and other fine matter when contacted against the angle of the bristle elements, but allow a substantial amount of the engaged or transferred matter to be wiped from the outer surface of the first material when the motion of the contacting surface is in the same direction of the angled bristle elements. A laundering aid that is 'self-cleaning' with respect to hair, lint, etc., advantageously maintains the bristles substantially free of such matter that if otherwise accumulated to a sufficient degree, could clog or block the bristles and compromise their ability to engage and dislodge the remaining adherent matter. Similarly, a brush-like surface may be selected that dislodges adherent matter transferred thereto because it lacks necessary structure to effectively retain transferred matter that might otherwise adhere to that portion of the covering.

In another aspect of the invention, the covering comprises a second material having different functional characteristics than the first material, such as a fabric that generally does not include a brush-like surface adapted for engaging and lifting matter from fabric. Preferably, the second material is combined with the first material in a configuration that enhances the action of the laundering aid to dislodge hair or other fine matter from the surfaces of the fabric articles within the dryer environment. One such way is by the second material enhancing the electrostatic charge of the laundering aid to allow it more effectively attract or suspend loosened hair or other adherent material from the surface of the fabric articles. Additionally, the second material may comprise a surface that particularly non-adherent to the dislodged matter so that as individual hairs or other pieces of material are pushed or otherwise deposited over that surface from an adjacent brush-like surface, they are more easily redislodged and vented from the drying chamber rather than be retained on the laundering aid. The second material can be disposed adjacent to and sewn together with the first material such that a plurality of sections are created (e.g., four quadrants comprising two sections of each material). Alternatively, the second material can be disposed partially underneath the first material, such that the first material comprises strips or other discrete or interconnected sections of material with the second material comprising the outer surface of the covering therebetween. It is within the scope of the invention for the second material to be completely enclosed or covered by the first material.

In still another aspect of the invention, the core member includes a series of projections extending outward outward from the surface thereof that engage the covering or alternatively, are extendable through the covering, such as upon further inflation of the core member as the air inside expands when heat is supplied by the dryer. The projections may be configured such that they assist in engaging and tossing the fabric articles, concentrate electrons thereon to enhance the electrostatic charge of the laundering aid.

BRIEF DESCRIPTION OF THE DRAWING

Embodiments of the present invention will now be described by way of example with reference to the accompanying drawings, in which.

DETAILED DESCRIPTION

Figure 1:
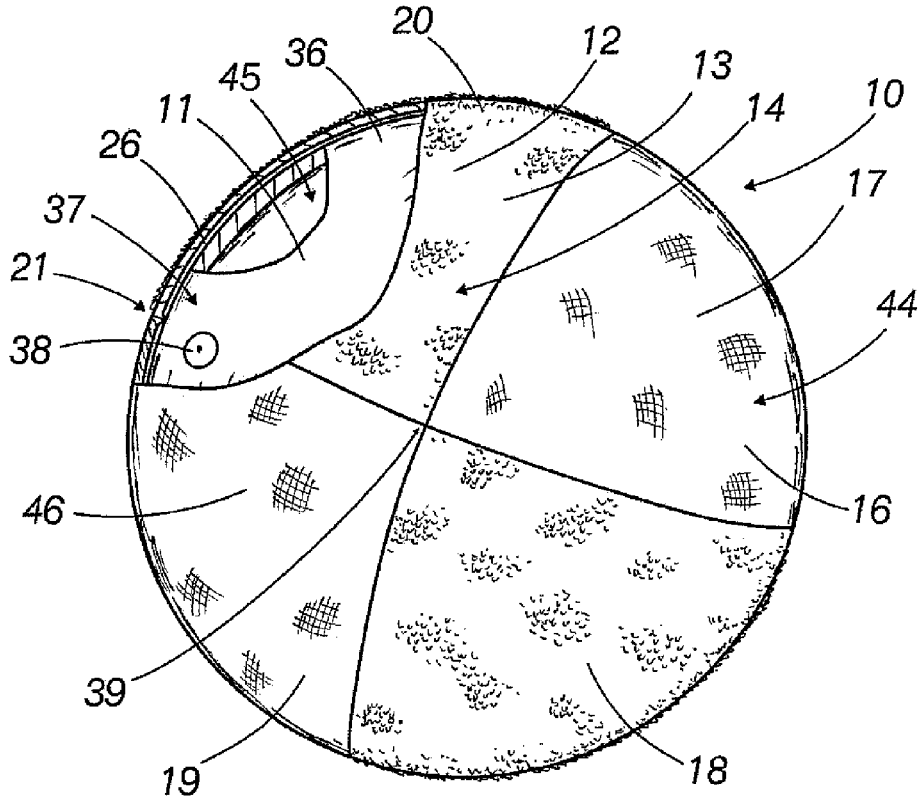
FIG. 1 depicts a partially sectioned perspective view of an illustrative embodiment of the present invention.

The following detailed description and appended drawings describe and illustrate various exemplary embodiments of the invention. The description and drawings serve to enable one skilled in the art to make and use the invention. The materials, methods, and examples disclosed herein are illustrative only and not intended to be limiting. Unless otherwise defined, all technical terms used herein have the same meaning as commonly understood by one of ordinary skill in the art to which this invention pertains. In case of conflict, the present document, including definitions, will control. Preferred methods and materials are described below, although methods and materials similar or equivalent to those described herein can be used in the practice or testing of the present invention.

The term "adherent", when referring to the mechanism by which hair, fur, lint, and other fine matter engages the surface of fabric articles (such as clothing) encompasses any action by which such matter is held against a fabric surface, including physical engagement with fibers of the fabric, surface tension, electrostatic attraction, and other means of engagement.

As used herein, a particular surface is 'adapted to engage and lift adherent matter' if it includes structural adaptations, such as bristles, loops, hooks, etc., that project outward from a surface and are appropriately configured for engaging and lifting or otherwise dislodging adherent matter (defined above), such as animal hair or lint, away from a surface to which it has engaged. The structural adaptations for engaging and lifting or otherwise dislodging adherent matter are generally distributed over the surface of the material or an underlying substrate. The term is not be interpreted to include surfaces that are merely abrasive or rough, such as a grit-covered surfaces, and which do not include structural elements distributed thereover that are configured lift and dislodge the adherent matter, although the roughness of the particular surface may at least in part cause limited dislodgement of hairs or other fine matter from fabric upon contact. It should be understood that some dislodgement of hair and fine matter is normal during the drying process, even in the absence of a device to aid such dislodgement. With respect to a 'brush-like surface adapted to engage and lift adherent matter', it should not be understood to include all brush-like surfaces, such as those having projections not configured for abrading a fabric surface to effectively pull up and at least partially dislodge fine hairs and similar matter or those not suitable for contact with fabric without causing damage. One skilled in the art would be able to determine if a particular brush-like surface is appropriately configured for lifting away hair and other fine matter from a fabric surface.

Referring now to the drawings, the laundering aid 10 of the present invention, a first illustrative embodiment of which is best depicted in FIGS. 1-4, comprises a core member 11, such as the illustrative elastomeric ball member 36 that includes a covering 12 partially or completely disposed thereover, the covering including a first material 13 having an abrasive surface such as as the illustrative brush-like surface 14 commonly found on a lint brush or mitt for removing pet hair, dandruff, lint, etc., from clothing. The illustrative covering 12 further includes a second material 16 comprising a fabric or other material having different properties than the first material, including substantially lacking the brush-like characteristics 14 found on the first material 13. The first and second materials 13, 16 may comprise adjacent section 17, 18 that are sewn or attached to one another along an interface 21 to form the covering 12, or one material may at least partially cover or be disposed upon the other.

Figure 9:
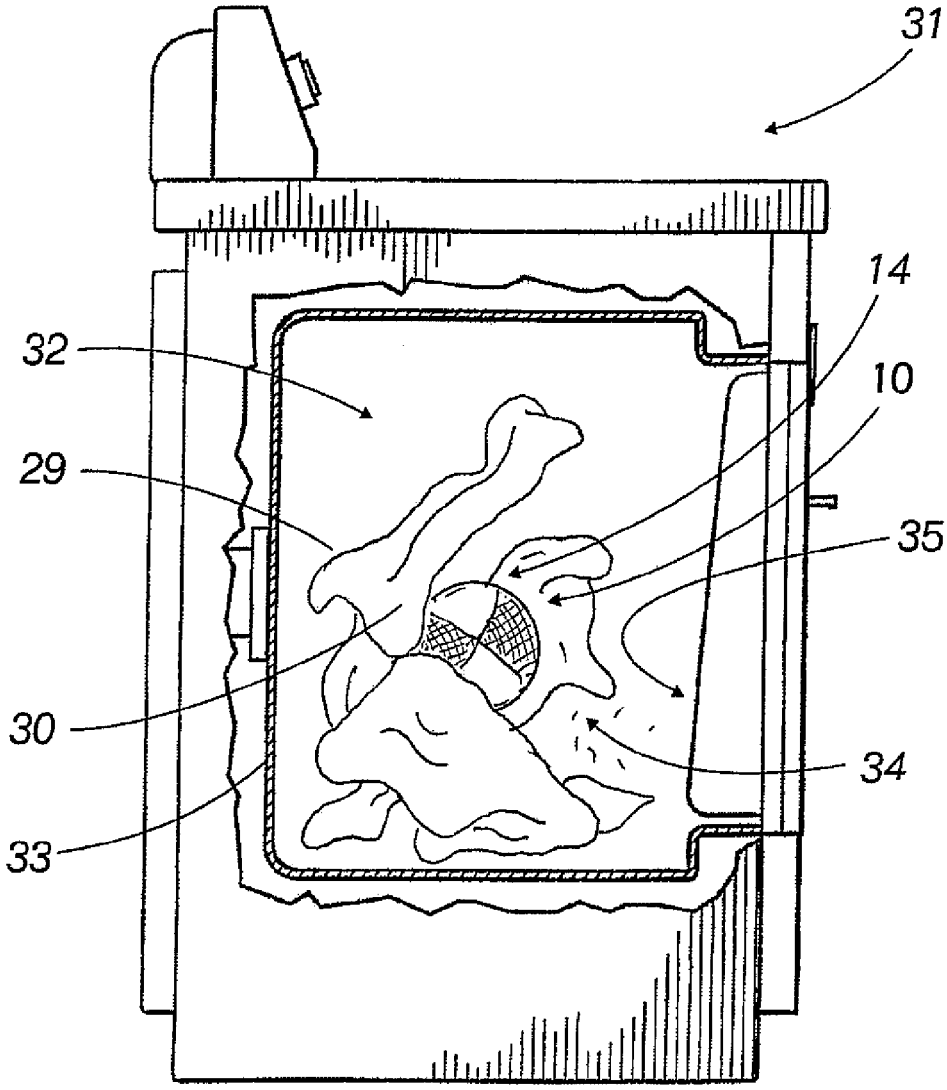
FIG. 9 depicts the embodiment of FIG. 1 and fabric articles within an operating tumble-type clothes dryer.

A method for using the illustrative laundering aid involves placing the laundering aid 10 inside a tumble-type clothes dryer 31 (FIG. 9) along with one or more fabric articles 29 covered at least partially with adherent matter 30, such as pet hair, lint, or other fine material, preferably prior to the beginning of the drying cycle. The dryer 31 is then operated such that the weighted laundering aid 10 tosses along with the fabric articles 29, helping to separate them and repeatedly making contact to lift and dislodge the adherent matter 30 from the surface of the fabric articles. As the dislodged matter 34 is pulled away from the fabric articles and/or the laundering aid 10, it is drawn toward the dryer vent 35 where it is deposited on the lint trap. Contact between the laundering aid 10 and the drum 33 and fabric articles 29 may advantageously cause the general buildup of an electrostatic on the laundering aid 10 that may be useful in helping to draw the partially dislodged matter away from the fabric articles to facilitate there removal from the drying chamber 32. When the drying cycle is completed, the laundering aid 10 is typically removed from the drying chamber 32. If any transferred matter remains on covering afterward, it is brushed away before the laundering aid is used again with a different load of fabric articles in a subsequent drying cycle.

FIG. 1 depicts a partially sectioned view of an illustrative laundering aid 10 of the present invention in which core member 11 comprises a hollow natural latex or synthetic rubber ball member 36 that has been inflated with air or another fluid such that the ball member is retains its generally spherical shape. The illustrative ball member 36 comprises an elastomeric material, such as natural or synthetic rubber (latex, silicone, etc.), such that the ball member is compressible and expandable as the internal air pressure increases when the ball member is subjected to the elevated temperatures within the dryer environment. Both thermoset and thermoplastic elastomers may be suitable for forming the ball member 36. The initial air pressure at room temperature within the inflatable chamber 45 should be sufficiently low to allow expansion of the ball member 36 such that it does not rupture from over-pressurization. The material of the core member 11 may comprise a variety of a synthetic and natural materials resulting in the core member being readily flexible/compressible, semi-rigid or substantially rigid (e.g., comprising a high durometer polymer or a metal. Examples of other possible polymers for the core member include, but are not limited to polyurethane, polycarbonate, acrylic, polytetrafluoroethylene, PVC, polyolefin, and styrene. Additionally, the core member 11 may comprise a solid material (e.g., solid rubber or an open or closed cell foam), or include a series of chambers and/or a fill material (e.g., sand or other filler) therewithin to add weight and define the shape. The core member 11 may comprise a stable shape independent of the covering, such as a spherical or oblong ball member 36 or other element. When the core member 11 comprises multiple elements or fill material, the core member may adopt the shape of the covering 12 that encloses and defines the outer surface 37 of the collective elements therein that comprise the core member.

The core member 11 may be sealed and inflated (pressurized), such as via the illustrative fill valve 38, or have one or more openings, relief valves, or pores to allow for the passage of air therethrough, such as to allow for expanding air to escape to avoid over-pressurization. While the illustrative embodiment includes a single core member 11 with a covering 12 thereover, the core member 12 could alternatively include a plurality of elements, such a multiple rubber balls that are collectively held together within the outer covering 12. The weight of laundering aid 10 should preferably fall within a range that allows it to be sufficiently light to be tossed among the fabric articles within the operating tumble-type dryer (rather than riding at the bottom of the drum), yet allow it to carry sufficient mass that it has the ability to contact the fabric articles with enough force to dislodge the matter therefrom. The dimensional range for the illustrative aundering aid is about 2-7 inches in diameter being preferred, with a more preferably range of about 3-6 diameter and a most preferred diameter of about 4.5 to 5.5 inches. Good results were obtained using an exemplary laundering aid 10 (FIG. 1) comprising an average diameter (prior to any expansion) of about 5 inches (13 cm) and a weight of about 6 oz (166 g).

The illustrative covering 12 of the embodiment of FIGS. 1-4 comprises both a first material 13 layer and a second material 16 configured in four separate sections 17, 18, 19, 20, alternating with one another, that are sewn together along an interface 21 or seam with an appropriate thread 22 or otherwise attached or bonded by another well-known method, the first material 13 comprising sections 17 and 19 with the second material 16 comprising sections 18 and 20. The first and second materials 13, 16 preferably include different properties that compliment one another to better facilitate the lifting and venting away of dislodged animal hair or other adherent matter, although it is within the scope of the invention for the laundering aid 10 to substantially comprise only the first material 13.

Figure 2:
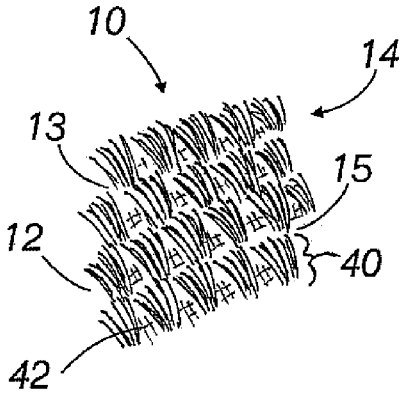
FIG. 2 depicts a perspective detail view of the brush-like covering surface of the embodiment of FIG. 1.
Figure 3:
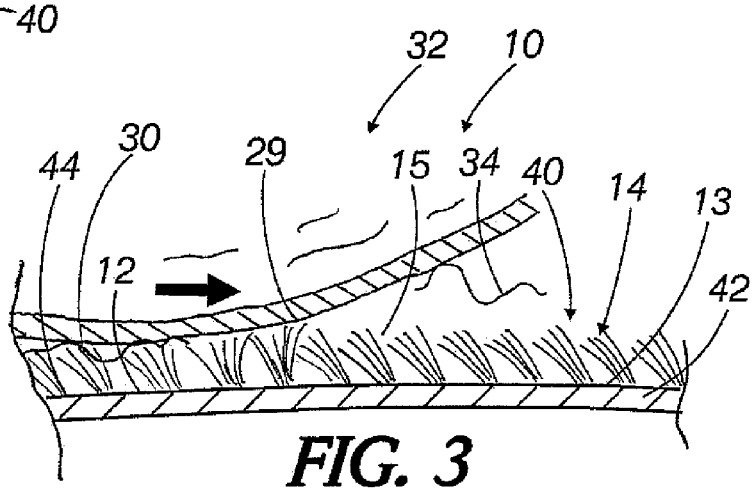
FIG. 3 depicts a side view of the brush-like surface of the embodiment of FIG. 1 engaging and dislodging adherent matter from a fabric article.
Figure 4:
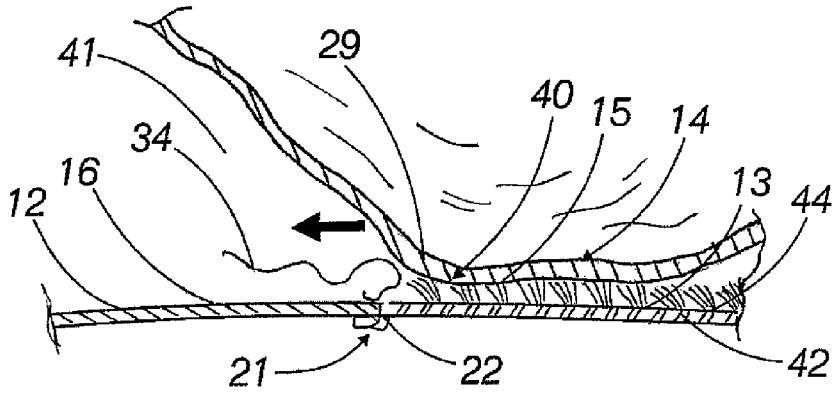
FIG. 4 depicts a side view of the adherent matter of FIG. 3 being dislodged from the brush-like surface to the second material.

The first material 13 of the illustrative embodiment comprises a brush-like material 14, such as the fabric or sheet material that is used for lint brushes or mitts. The illustrative brush-like material 14 shown in FIGS. 2-4 comprises a dense arrangement of polymeric microfiber bristles 15 that are configured to abrade the surface of fabric such that adherent hairs and other fine debris or matter encountered by the bristles moving across the fabric surface become loosened such that they may be either lifted away by the bristles themselves or dislodged in part by electrostatic or other forces generated by the laundering aid or the environment of the dryer. As depicted in FIG. 2, the brush-like material 14 comprises a woven fabric substrate 42 with plurality of oriented brush elements 40 each comprising a discrete grouping of microfiber bristle elements 15 (e.g., nylon, polyester, acrylic, polypropylene or another suitable synthetic fiber), about 1-2 mm in length, each brush element being angled and oriented in a common direction such that the brush-like surface is primarily effective for dislodging matter in one general direction only. Alternatively, the bristles elements 40 may be oriented generally perpendicular to the substrate 42 or at random or variable angles with respect to one another such that the brushing action in not limited to one direction. Microfibers are typically defined as any fiber less than 1 denier in size. Although the microfibers are advantageously fine such that the microfiber bristles 15 are not likely to damage fabrics with which they come into contact, they have sufficient rigidity, especially when arranged in brush element groupings 40, such that they are able to at least substantially loosen or dislodge the adherent hair or fine matter upon contact. As depicted in FIG. 3, the diameter of the bristles 15 is sufficiently small such that they are able to insert themselves between the surface of the fabric article 29 and fine hairs 30 or similar size matter, sometimes temporarily ensnaring them among the bristles, until they are pulled at least partially away from the surface to which they adhere. In some instances, the hair or other adherent matter 30 may be transferred to the surface of the illustrative first material 13. The angled brush elements 40/bristles 15 are not adapted to trap and retain the matter, however. Rather, configuration of the angled brush-like surface 14 allows for a substantial number of the mammalian hairs or other fine pieces of adherent material 30 that have become transferred to the brush-like surface 14 to be wiped free as the outer surface 44 of the covering 12 contacts other surfaces within dryer environment 32. As the transferred matter 41 dislodges from the covering outer surface 44, it is able to be vented with the remainder of the dislodged matter 34 (FIG. 4). Obviously, at the completion of the dying cycle, any hairs or other matter that have not yet been wiped across the surface and freed may remain, usually in a partially attached state along with a limited number of other hairs that may adhere for various reasons. Depending on the configuration of the covering 12, some hair or other fine matter than may become entangled within the bristle elements 15 of the illustrative embodiment; however, most matter transferred to the illustrative first material 13 should eventually be wiped free within the dryer environment, given sufficient time and opportunity.

An example of a first material 13 with brush-like characteristics 14 that is generally unidirectional in it's ability to lift hairs, while allowing cleaning or purging of the brush-like surface in the opposite direction can be found on commercially available products, such as the Pet Hair Pic-Up Mitt or the Magik Brush Lint Brush from The Evercare Company (Alpharetta, Ga.). This material, generally depicted in FIG. 2, comprises tufts of bristles (brush element 40) that are incorporated into a woven fabric substrate 42 and both aligned with one another in rows with the bristles 15 being angled in a common direction with respect to the substrate (FIGS. 2-4). As such, the bristles 15 are configured to engage hairs and other matter 30 when brushed across the surface of the fabric article 29 in a direction generally opposite that toward which the bristles are angled (FIG. 3). This configuration advantageously allows the brush elements 40/bristles 15 to be forced downward when the brush-like surface 14 contacts a surface applying pressure thereagainst in the general direction of the bristle angle, thus allowing the brush-like surface to be substantially wiped free of any hairs or matter 30 (FIG. 4). The brush elements 40 may be aligned in longitudinal or diagonal rows, or they may be aligned in groups of rows (e.g., four rows per group) that are staggered or offset with respect to adjacent groups of rows. Alternatively, the brush elements 40 may be distributed in a random or unaligned pattern or the individual bristles 15 may not be grouped together, but rather are generally distributed in non-grouped pattern (e.g., in a generally even distribution) over the first material 13 surface.

Although the illustrative brush-like surface 14 of FIG. 2 and it's variants may be particularly advantageous for the removal of adherent matter without damaging fabric in the process, it is within the scope of the invention for the first material to comprise other abrasive and brush-like surfaces that are adapted for lifting and dislodging hair and other fine matter that has become adherent to fabric. The density, lengths, arrangement, and orientation of the bristle elements 15 can be variable, depending on the overall configuration of the device and its intended use. An average individual, and certainly one skilled in the art, should not have difficulty in determining whether a particular bristle element 15 type or brush-like surface 14 is efficacious for physically engaging and dislodging pet hair or other matter from the desire type or types of fabric that the laundering aid 10 will be attempting to treat within the dryer environment and to what extent the transferred matter will continue adhere to such a surface for the duration of the treatment.

Generally, materials appropriate for the working surfaces of lint and hair removal brushes and devices are suitable as a first material 13 of the outer covering 11 of the laundering aid 10. Densely arranged, flexible bristles 15 have been shown to be particularly effective for that purpose. Bristle members 15 having the potential to cause damage to the fabric articles, due to their configuration (e.g., size and/or stiffness), typically should be avoided. It is particularly advantageous to select a first material 13 that reduces or largely eliminates the need to manually remove adherent matter transferred to the covering 12. For this reason, short bristles (e.g., $\leqq$5 mm) that can be readily purged of matter (by contact during the drying cycle or manually afterward) are generally preferred over those that may deeply trap matter between the bristles.

Still referring to FIGS. 1-4, a second material 16 comprising the covering 12 may be selected to comprise a portion of the covering 12 and compliment the action of the first material 13 in dislodging and facilitating the venting of hair or other adherent matter 30 from the dryer environment 32. For example, certain fabrics or materials may be selected having an electron affinity that facilitates the attraction of the adherent matter 30 from the fabric article 29 outer surface, particularly if partially loosened or dislodged. Alternatively, the covering 12 or laundering aid 10 in general maybe be configured such that the electrostatic charge of the second material 16 may result in the covering 12 acting to repel dislodged hair or material within the operating tumble-type dryer to keep the matter suspended and unattached long enough to be vented from the dryer, particularly if the other materials that comprise the laundering article are compatible to cause such a charge. An electrostatic charge repulsive to hair (typically a positive one) or other fine matter may greatly reduce the tendency of the matter to be transferred to the surface of the covering 12.

As discussed, a combinational effect may occur when combining two different materials 13,16 that compliment one another to dislodge adherent matter from the fabric articles and the dryer itself. Using a relatively smooth fabric surface for the second material 16, particularly a synthetic or blended fabric, may increase the ability of the second material 16 to acquire electrons during frictional contact with other surfaces such that the outer surface of the laundering aid possesses a stronger negative electrostatic charge for attracting positively charged matter that might be otherwise possible. A second potential advantage of a complimentary second material 16 is providing an area of the covering from which the hair and other dislodged matter may be advantageously wiped from the first material and expelled. As hair, lint, etc., 30 is urged across the brush-like surface in the direction of the bristles, such as the type depicted in FIGS. 2-4, it may eventually be deposited over the smoother and even less adherent fabric surface of the second material 16, facilitating the dislodgement of the matter from the covering 12 so that it can be vented away.

Referring now to FIG. 1, the illustrative brush-like surface 14 of a particular section of the covering 12 (e.g., section 18) may be oriented with respect to other sections of the first or section material 13, 16 (e.g., 17,19,20) so that the bristles strategically engage or disengage the adherent matter in a particular direction that is advantageous for it's collection and/or removal. For example, the brush-like surface 14 may be oriented to direct the disengaging adherent matter toward an adjacent section of second material 16 for faciliating dislodgement from the covering 12, or two or more sections of the first material may be oriented toward a point of convergence 39 therebetween so that the hair or fine material is concentrated at one point on the covering. Or, alternating sections may be oriented that two oppositely located points of convergence 39 such that half of the transferred matter is swept toward one 'pole' (point 39) and half to the opposite other point. Alternatively, a section (e.g., a round 'end cap' or portion) comprising a smooth, non-adherent material (including a third material selected for that purpose) could be disposed about the point of convergence 39 (e.g., between brush-like material sections 17,19) so that the adherent matter being directed there by the angled brush-like surfaces 14 would be more readily dislodged as it is moved thereonto. The percentage of the first material 13 relative to the second material 16 resulting in the optimum balance for facilitating the removal of adherent matter will depend on the materials selected, but the abrasive or brush-like surface that advantageously comprises at least a third of the outer surface 44 of the laundering aid (33%) is most effective for most applications. Additionally, the abrasive or brush-like surface 13 may comprise about 40, 50, 60, 70, 80, 90 or 100% of the outer surface 44. More preferably, about 45-75% of the outer surface 44 should comprise a material adapted for lifting hair and other adherent matter, and most preferably about half to about two-thirds (67%) of the outer surface 44 should be of the abrasive or brush-like material.

The efficacy of a particular fabric comprising the second material 16 in contributing to the dislodgement and removal of adherent matter from the fabric articles may vary according to the fabric type, thread count, or treatments or coatings of the fabric of the covering 12 or the particular fabric article being cleansed of matter. The durability of the material for repeated use within the environment of a dryer is another consideration. Both synthetic and natural fibers, and blends thereof, may be used to comprise the second material. Selection of a synthetic or blended material may be most effective in combination with the first material 13 for removing adherent matter from some types of fabric, but the selection of the second material may be dependent on the type of fabric articles being laundered and their fabric type. Examples of possible synthetic fabrics to comprise the complimentary second material 16 include, but are not limited to acrylic, nylon, acetate, chiffon, crepe, fleece, moquette, percale, polyester, polyolefin (olefin), PVC, rayon, sateen, satin, spandex, lamé, tulle, viscose and others. Many of these generally have a tendency to acquire a negative charge when subject to frictional forces against a surface that gives up electrons. Such a material may increase the overall negative electrostatic charge of the laundering aid 10, which typically comprises a polymeric core member 11 and synthetic brush-like fabric 13, both materials that also tend to acquire a negative surface charge within the dryer environment. The polymeric brush-like surface material 14, while typically made of a material positioned within the 'negative' end of the triboelectric series, may not as readily acquire electrons from a adjacent surface because of it's structural or surface characteristics. The the smoother synthetic fabric of the second material 16 is typically better adapted to acquire electrons and/or distribute them in a manner that may increase the negative electrostatic charge on the covering 12 that could aid in lifting hairs and adherent matter from clothing and other fabric articles.

The second material 16 may also comprise natural fibers or a synthetic-natural fiber blend. Examples of natural animal fibers include, such wool, flannel, felt, jersey, silk, tweed, worsted, mohair, leather, cashmere, chenille, gabardine, taffeta, etc. Fabrics or materials made from plant fibers, comprise a list that includes cotton, denim, linen, terry, velvet, corduroy, canvas, cheesecloth, muslin, poplin, organdy, etc. Although in general, natural fibers are not as likely to acquire a negative electrostatic charge sufficient for attracting partially dislodged hair from surfaces as would polyester and many other synthetic fabrics, it is also possible for animal hair and other adherent matter to acquire a negative or neutral charge such that an negatively charged outer surface 44 of the laundering aid 10 may of little assistance in the dislodgement of the hair or other fine matter.

Still referring to FIG. 1, optional coatings 46 and other treatments, such as polymer deposition, can be used to alter the properties of the covering 12, particularly the second material 16. For example, PTFE or silicone, or other materials at the negative end of the Triboelectric Series, have been used to coat fabrics for various purposes. The addition of the polymer may further strengthen any electrostatic charge acquired by the covering 12 within the dryer environment. Additionally, certain polymer coatings, such as PTFE, might permit either the first or section materials 13,16 to become even less adherent to matter that might be transferred thereto. It would be expected that polymer coatings would have a greater impact in altering the properties of natural fiber fabrics comprising the second material 16, making them more likely to attract electrons and become negatively charged than they might without such a coating The process for making the illustrative laundering aid 10 of FIG. 1 can be performed in a number of variety of ways. In one exemplary method of manufacturer, four flat and generally ovoid ('football shaped') sections of fabric 17,18,19,20 are provided that may include different types of materials to take advantage of the possible combinational advantages, a discussed above, and/or different colors for visual contrast and/or aesthetic reasons. The four section are each sewn together along a series of seams 21 with a suitable type of thread 22 (FIG. 4) or otherwise bonded together with the excess material of the seam 21 being oriented toward the inner surface of the covering 12, the covering 12 being sewn or stitched together so that it is inverted or inside-out with respect to its final orientation. Typically, one seam between adjoining sections (e.g., 17,18) or a portion thereof is left unstitched so that the collapsed or uninflated elastomeric ball 36 (or other core member 11) can be placed against the covering. The covering 12 is then is then folded and inverted over the core member via the unstitched region (opening through the covering) so that the intended outer surface of the covering 12 faces outward and the core member 11 is enclosed therein. The elastomeric ball member 36 is then inflated through the illustrative fill valve 38 to an appropriate volume that allows for expansion during heating, and the remainder of the seam 21 is then sewn to completely enclose the core member 11.

Figure 5:
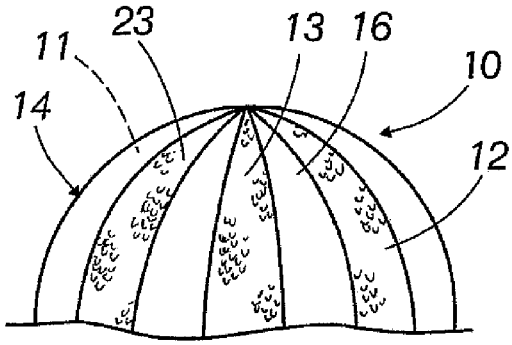
FIG. 5 depicts a side view of a second illustrative embodiment of the present invention.
Figure 6:
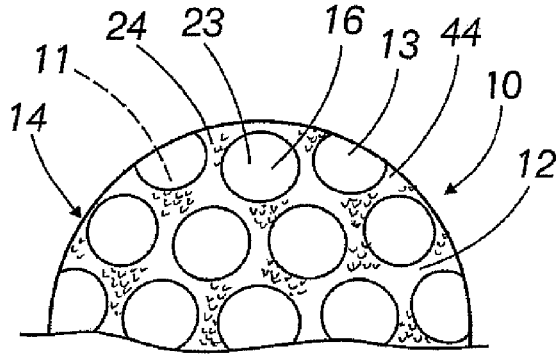
FIG. 6, depicts a side view of a third illustrative embodiment of the present invention.

Still referring to FIG. 1, the covering 12 of the present invention, which may consist of only the first material 13 or comprise the first and second materials 13,16 (or additional materials), may be disposed either as a layer of material that encloses, but is unattached to the core member 11 such that there a space 26 therebetween, as depicted in FIG. 1, or at least a portion of the covering 12 may be affixed directly to the outer surface 37 of the core member 11. Leaving the covering 12 unattached to the core member 11 allows for the expansion thereof while minimizing stress on the covering 12. The second material 16 may comprise a woven or non-woven fabric or layer of material, or it may be applied directly to core member 11 in particulate (e.g., fiber) form, such as by a flocking process, whereby the outer surface 37 of the core member 11 or the particular material is treated to cause bonding therebetween. Alternatively, the second material 16 may be spun as a continues thread (or series thereof directly over the outer surface 37 of the core member 11. As shown in FIG. 5, the second material 16 may comprises a base layer of material over which the first material 13 is disposed, such as in the illustrative strips 23 or sections that are glued, thermally bonded, sewn, or otherwise affixed to the outer surface of the second material 16. The first material 13 may also comprise a single outer sleeve member 24 (FIG. 6) that encloses and overlays the underlying second material 16, the sleeve member being stitched together after the core member 11 covered with second material 16 is inserted thereinto. The illustrative sleeve member 24 includes a series of open spaces 25 through which the second material 16 becomes part of the outer surface 44 of the covering 12, these spaces may potentially serve as enhanced electrostatically charged regions or become areas for the reception and dislodgement of hair or fine matter that is wiped from the adjacent brush-like surfaces 14 of the first material 13. The sleeve member 24 may be attached to the underlying substrate in a number of discrete points, such as by stitching, bonded over the entire undersurface of the sleeve, or remain attached to the underlying material.

Figure 7:
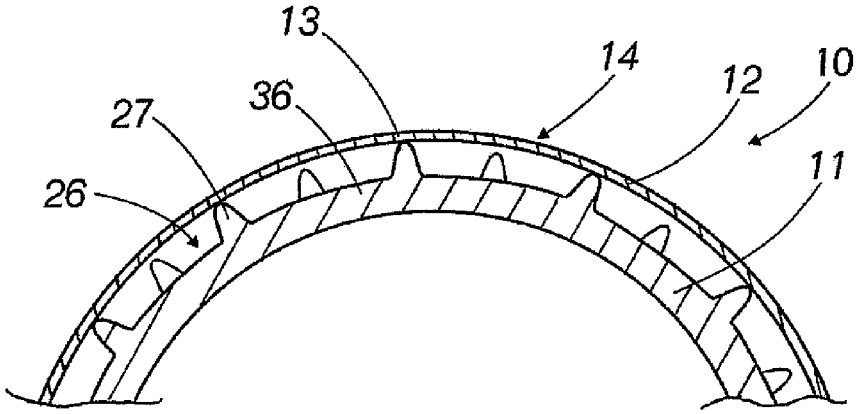
FIG. 7 depicts a cross-sectional view of fourth illustrative embodiment of the present invention.

FIG. 7 depicted an embodiment of a core member 11 that comprises an polymeric ball member 36 have a series of knob-like protuberances 27 distributed thereover with the outer covering 12 being disposed over of the protuberances. While the size, shape, and density of the protuberances 27 may be selected with multiple considerations in mind, it is generally preferred that they do not cause excessive wear against the inner surface of the fabric covering 12. As such, a broadly truncate or rounded protuberance, generally of the type depicted, may be preferred underneath a fabric covering 12. In one embodiment, the protuberances 27 may be strategically placed within the open spaces 25 of the first material 13 covering depicted in FIG. 6, but preferably they should be spaced and configured such that they do not interfere with the brush-like action of the first material 13. The protuberances 27, whether covered or uncovered, may assist in helping to engage and separate the fabric articles during the drying process. Furthermore the protuberances may help alter the electrostatic state of the laundering article as it is known that free electronics tend to concentrate about point-like structures and other projecting surfaces.

Figure 8:
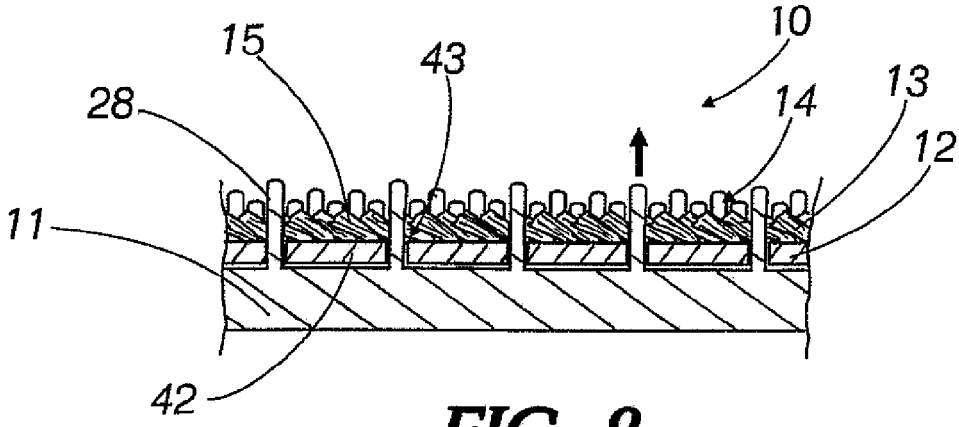
FIG. 8 depicts a cross-sectional view of a fifth illustrative embodiment of the present invention.

A second embodiment having projecting or extendable protuberances 28 is shown in FIG. 8 in which the protuberances extend through the covering 12 through a series of illustrative apertures 43 formed therethrough. The protuberances 28 may have utility in mechanically engaging and separating the fabric articles, providing supplemental dislodgement of adherent matter, and/or providing points at which electrostatic charges concentrate to help attract partially dislodged hair and other fine matter where it may be expelled and vented from the dryer. The protuberances 28 may be configured such that they permanently extend through the fabric, or they be configured to be extendable only upon heating and expansion of the core member 11 during the drying process. Preferably, the projecting protuberances 28 comprise a flexible material that is not as likely to damage the fabric article with which they come into contact within the dryer and are configured so as not to interfere with the action of the brush-like surface 14.

It is therefore intended that the foregoing detailed description be regarded as illustrative rather than limiting, and that it be understood that it is the following claims, including all equivalents, that are intended to define the spirit and scope of this invention.

What is claimed is:

1. A laundering aid having an outer surface adapted for removing adherent matter from fabric articles within an operating tumble-type dryer, comprising:

a core member having an outer surface; and a covering comprising at least a first layer of material generally disposed circumferentially over at least a portion of the outer surface of the core member, the first layer of material substantially comprising a brush-like surface having bristles adapted that engage and lift the adherent matter from the surface of the clothing articles as the laundering aid repeatedly contacts the fabric articles within the operating tumble-type dryer; and wherein the brush-like surface of the covering substantially dislodges the adherent matter such that it is transferred thereonto and/or vented from the dryer.

2. The laundering aid of claim 1, further comprising a second material disposed over the core member, the second material comprising a fabric material generally lacking the brush-like surface characteristics.

3. The laundering aid of claim 2, wherein the outer surface of the laundering aid comprises one or more sections of the first material and the second material disposed adjacent to one another and over the core member.

4. The laundering aid of claim 2, wherein the first material is disposed on top of the second material over at least a portion thereof.

5. The laundering aid of claim 2, wherein outer surface of the laundering aid comprises at least two sections of the first material and at least two sections of the second material such that outer surface of the laundering aid comprises alternating sections of brush-like surface and surface lacking brush-like characteristics.

6. The laundering aid of claim 1, wherein the core member comprises a generally spherical member comprising a polymeric material.

7. The laundering aid of claim 6, wherein the core member comprises an elastomeric material and further includes an inner chamber at least partially inflated with a fluid to a first internal pressure sufficiently high such that the core member generally retains its shape during contact with the fabric articles, but with the first internal pressure being sufficiently low to accommodate expansion of the fluid within the core member to a second pressure upon being heated during a normal drying cycle such that core member does not rupture from over-pressurization.

8. The laundering aid of claim 6, wherein the outer surface of the core member comprises a series of outward projections extending therefrom.

9. The laundering aid of claim 1, wherein the outward projections are extendable through the covering of the laundering aid.

10. The laundering aid of claim 1, wherein the brush-like surface comprises a closely-adjacent arrangement of short, bristle elements.

11. The laundering aid of claim 10, wherein the brush-like surface comprises a plurality of discrete brush elements, each comprising a plurality of microfiber bristle elements.

12. The laundering aid of claim 10, wherein the bristle elements are generally oriented in a single direction to engage the adherent matter, wherein the adherent matter is readily dislodgeable from the brush-like surface when friction from a second surface is applied in the direction of the bristle elements.

13. The laundering aid of claim 1 comprising a configuration such that the laundering aid acquires an electrostatic charge during use of the device within the operating tumble-type dryer such that the laundering aid is generally attractive to mammalian hair.

14. A method for removing adherent matter from fabric articles within an operating tumble-type dryer, comprising the steps of:

providing a laundering aid comprising a core member having a covering that includes a first material having a brush-like outer surface comprising bristles that engage and lift adherent matter, including mammalian hair, from fabric articles when repeatedly contacting the fabric articles within the operating tumble-type dryer;

placing the laundering aid among one or more fabric articles at least partially covered with adherent matter inside the tumble-type dryer; and operating the tumble-type clothes dryer until a substantial proportion of the adherent matter has been dislodged from the fabric articles and transferred to the covering and/or vented from the drying chamber.

15. The method of claim 14, wherein the core member of the laundering aid comprises an at least partially inflated polymeric ball member and the covering further includes a second material comprising a fabric disposed adjacent to one or more sections of the first material, the fabric being of a different type than the first material.

* * * * *